US012808020B2

(12) United States Patent
Jing et al.

(10) Patent No.: US 12,808,020 B2
(45) Date of Patent: Nov. 24, 2026

(54) HIGH-PLASTICITY DUAL-PHASE HIGH-ENTROPY ALLOY AND PREPARATION METHOD THEREOF

(71) Applicant: SHAANXI UNIVERSITY OF TECHNOLOGY, Hanzhong (CN)

(72) Inventors: Ran Jing, Hanzhong (CN); Xiong Zhang, Hanzhong (CN); Qing Zhang, Hanzhong (CN); Taotao Ai, Hanzhong (CN); Jianghua Li, Hanzhong (CN); Pengfei Chui, Hanzhong (CN); Yang Zhang, Hanzhong (CN); Zhongni Liao, Hanzhong (CN)

(73) Assignee: SHAANXI UNIVERSITY OF TECHNOLOGY, Hanzhong (CN)

( * ) Notice: Subject to any disclaimer, the term of this patent is extended or adjusted under 35 U.S.C. 154(b) by 392 days.

(21) Appl. No.: 18/576,437

(22) PCT Filed: Jul. 13, 2023

(86) PCT No.: PCT/CN2023/107166
§ 371 (c)(1),
(2) Date: Jan. 4, 2024

(87) PCT Pub. No.: WO2024/178896
PCT Pub. Date: Sep. 6, 2024

(65) Prior Publication Data

US 2025/0092494 A1 Mar. 20, 2025

(30) Foreign Application Priority Data

Mar. 2, 2023 (CN) ..... 202310195068.9

(51) Int. Cl.
*C22C 30/00* (2006.01)
*C22C 1/02* (2006.01)
*C23F 3/06* (2006.01)

(52) U.S. Cl.
CPC ..... *C22C 30/00* (2013.01); *C22C 1/02* (2013.01); *C23F 3/06* (2013.01)

(58) Field of Classification Search
CPC .. C22C 30/00; C22C 1/02; C23F 3/06; C23G 5/00
See application file for complete search history.

(56) References Cited

U.S. PATENT DOCUMENTS

2018/0363104 A1 12/2018 Fujieda et al.

FOREIGN PATENT DOCUMENTS

CN 106119835 A 11/2016
CN 107267844 A 10/2017
(Continued)

OTHER PUBLICATIONS

Liu Lei. C and Effect of Ti on coagulation tissue refinement and room temperature tensile properties of CrFeCoNi high entropy alloy, Series I (Monthly), Issue 6, Jun. 15, 2019, pp. 17-19, 47.
(Continued)

*Primary Examiner* — Jessee R Roe
(74) *Attorney, Agent, or Firm* — Rothwell, Figg, Ernst & Manbeck, P.C.

(57) ABSTRACT

Provided are a high-plasticity dual-phase high-entropy alloy (HEA) and a preparation method thereof. The high-plasticity dual-phase HEA has a chemical formula as shown in Formula I: $(FeCoNiCr)_{100-x}Ti_x$ (Formula I), in which, x is in a range of 2.0 to 2.8. A method for preparing the high-plasticity dual-phase HEA is also provided.

13 Claims, 1 Drawing Sheet

(56) References Cited

FOREIGN PATENT DOCUMENTS

| | | | |
|---|---|---|---|
| CN | 108517451 | A | 9/2018 |
| CN | 111647789 | A | 9/2020 |
| CN | 114346346 | A | 4/2022 |
| CN | 116121620 | A | 5/2023 |

OTHER PUBLICATIONS

International Search Report issued in PCT/CN2023/107166 dated Nov. 9, 2023, 12 pgs.

HIGH-PLASTICITY DUAL-PHASE HIGH-ENTROPY ALLOY AND PREPARATION METHOD THEREOF

CROSS REFERENCE TO RELATED APPLICATION

The application is a national stage application of International Patent Application No. PCT/CN2023/107166 filed on Jul. 13, 2023, which claims the priority and benefit of the Chinese Patent Application No. 2023101950689, entitled "High-plasticity dual-phase high-entropy alloy and preparation method thereof" filed with the China National Intellectual Property Administration (CNIPA) on Mar. 2, 2023. The two applications are each incorporated herein by reference in their entirety as part of the application.

TECHNICAL FIELD

The present disclosure relates to the field of metal materials, in particular to a high-plasticity dual-phase high-entropy alloy (HEA) and a preparation method thereof.

BACKGROUND

With the rapid development of science and technology in recent decades, traditional alloy design methods have reached a limit, and the emergence of high-entropy alloys (HEAs) provides another alloy design idea. Face-centered cubic HEAs represented by FeCoNiCrMn with an equiatomic ratio show a desirable elongation (approximately 60%) and a characteristic of "toughness and strength" at low temperatures, but have a yield strength of generally less than 200 MPa, greatly limiting their applications in engineering materials. Because FeCoNiCrMn is a single-phase alloy, it cannot be strengthened by heat treatment, and the strengthening by traditional work hardening greatly reduces its elongation. To solve this problem, such alloy has been modified by researchers through methods such as dispersed nano-second phase strengthening, multi-scale synergistic strengthening of gradient materials, and 3D printing-based additive manufacturing strengthening. However, these strengthening methods generally show high requirements for equipment and do not have the conditions for industrial application.

Therefore, it has become an urgent technical problem to be solved in this field to provide a dual-phase HEA with both high strength and high plasticity.

SUMMARY

The present disclosure aims to provide a high-plasticity dual-phase high-entropy alloy (HEA) and a preparation method thereof. The high-plasticity dual-phase HEA according to the present disclosure has both high strength and high plasticity.

To achieve the above object, the present disclosure provides the following technical solutions.

The present disclosure provides a high-plasticity dual-phase HEA having a chemical formula as shown in Formula I:

$$(FeCoNiCr)_{100-x}Ti_x \qquad \text{Formula I:}$$

in which, x is in a range of 2.0 to 2.8.

In some embodiments, x in Formula I is 2.4.

The present disclosure further provides a method for preparing the high-plasticity dual-phase HEA as described in the above solutions, including:

(1) subjecting a raw material to pretreatment to obtain a high-purity raw material; and (2) melting the high-purity raw material obtained in step (1) to obtain the high-plasticity dual-phase HEA.

In some embodiments, the raw material in step (1) includes Ni, Cr, Ti, Fe, and Co.

In some embodiments, the pretreatment in step (1) includes subjecting the Ni and the Cr to pickling and ultrasonic cleaning, and subjecting the Fe, the Ti, and the Co to ultrasonic cleaning.

In some embodiments, the pickling is conducted for 50 s to 70 s.

In some embodiments, a pickling solution for the pickling comprises one selected from the group consisting of a hydrochloric acid solution and a mixed aqueous solution of nitric acid and hydrofluoric acid.

In some embodiments, in the mixed aqueous solution of nitric acid and hydrofluoric acid, a mass percentage of nitric acid is in a range of 10% to 30%, and a mass percentage of hydrofluoric acid is in a range of 5% to 8%.

In some embodiments, the melting in step (2) is conducted in a protective atmosphere.

In some embodiments, the protective atmosphere is provided by argon.

In some embodiments, the melting in step (2) is conducted in a melting chamber.

In some embodiments, before the melting is conducted, the method as described in the above solutions further includes subjecting the melting chamber to primary vacuumizing, and introducing a protective atmosphere until a pointer of a gas valve points to 0 MPa, and then subjecting the melting chamber to secondary vacuumizing, and introducing the protective atmosphere until the pointer of the gas valve points to −0.05 MPa.

In some embodiments, the primary vacuumizing is conducted to a vacuum degree of not less than $8.4\times10^{-4}$ MPa.

In some embodiments, the secondary vacuumizing is conducted to a vacuum degree of not less than $3.0\times10^{-3}$ MPa.

In some embodiments, the melting in step (2) is conducted 3 to 5 times.

In some embodiments, the melting in step (2) is conducted at a temperature of 1,950 °C to 2,050 °C for 55 s to 65 s each time.

The present disclosure provides a high-plasticity dual-phase HEA, where the high-plasticity dual-phase HEA has a chemical formula as shown in Formula I: $(FeCoNiCr)_{100-x}Ti_x$ (Formula I), in which x is in a range of 2.0 to 2.8. In the high-plasticity dual-phase HEA according to the present disclosure, FeCoNiCr acts as a matrix, and Ti is added thereto in a small amount. On the one hand, the added Ti exerts an effect of solid solution strengthening, and on the other hand it could also combine with Ni in the matrix to form $Ni_3Ti$, which is an ordered face-centered cubic structure, has a high degree of coherence with the matrix, and could improve a strength of materials without affecting the plasticity. Further. Ti is quite different from the matrix elements in an atomic radius, resulting in lattice distortion to improve the yield strength and tensile strength of the alloy. Moreover, a desirable coherent interaction between dual phases of the alloy further ensures excellent plasticity of the alloy. Experimental results show that the high-plasticity dual-phase HEA according to the present disclosure has a maximum tensile strength of 710 MPa, a yield strength of 400 MPa, and an elongation of 62%, thereby ensuring excellent plasticity and high strength.

DETAILED DESCRIPTION OF THE EMBODIMENTS

Figure 1:
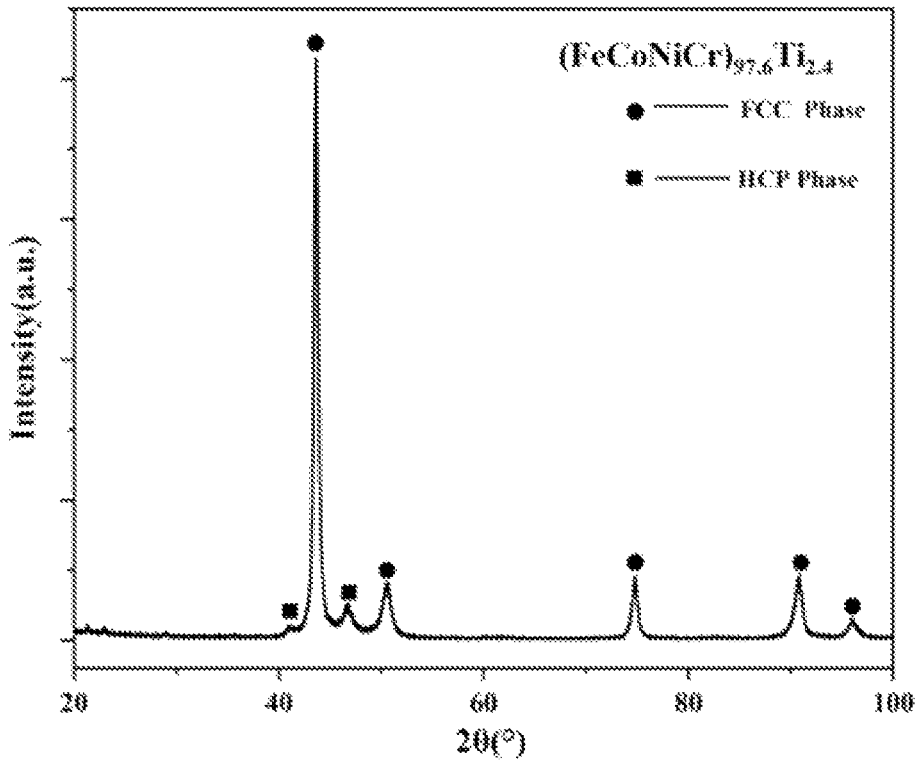
FIG. 1 shows an X-ray diffraction (XRD) pattern of the high-plasticity dual-phase HEA prepared in Example 1 of the present disclosure.
Figure 2:
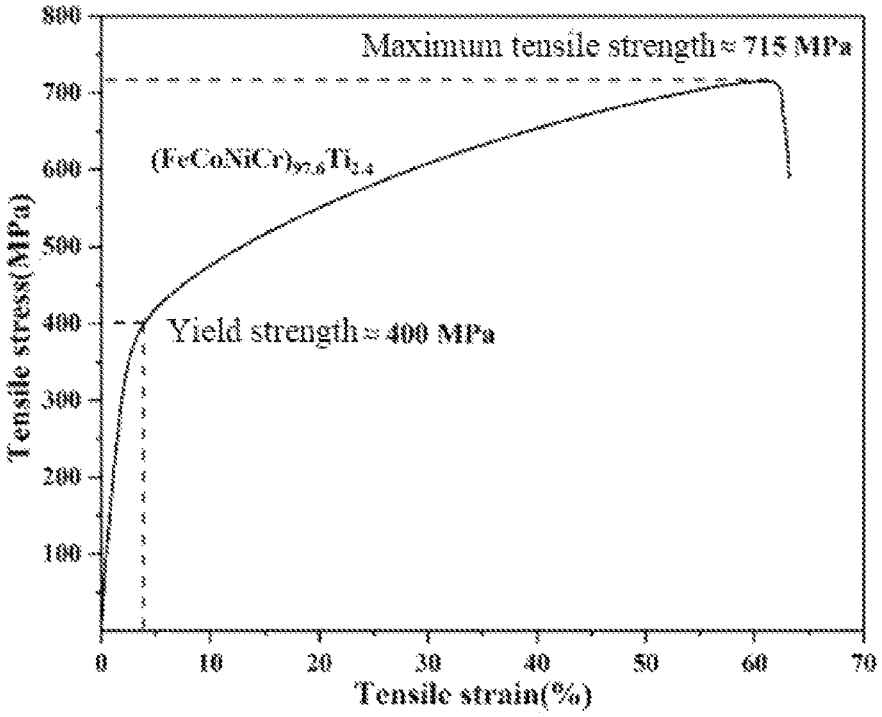
FIG. 2 shows a stress-strain curve of the high-plasticity dual-phase HEA prepared in Example 1.

The present disclosure provides a high-plasticity dual-phase HEA, where the high-plasticity dual-phase HEA has a chemical formula as shown in Formula I:

$$(FeCoNiCr)_{100-x}Ti_x \qquad \text{Formula I:}$$

in which, x is in a range of 2.0 to 2.8.

In some embodiments, x in Formula I is 2.4. In the present disclosure, x in Formula I represents an atomic percentage. In the present disclosure, the added Ti exerts an effect of solid solution strengthening, and could also combine with the Ni in the matrix to form a $Ni_3Ti$, which has a high degree of coherence with the matrix, and could improve the strength of materials without affecting the plasticity. Further. Ti is quite different from the matrix elements in an atomic radius, resulting in lattice distortion to improve the yield strength and tensile strength of the alloy. Moreover, a desirable coherent interaction in the dual-phase alloy further ensures excellent plasticity of the alloy.

In the high-plasticity dual-phase HEA according to the present disclosure, the FeCoNiCr acts as a matrix, and Ti is added thereto in a small amount. On the one hand, the added Ti exerts an effect of solid solution strengthening, and on the other hand it could also combine with Ni in the matrix to form $Ni_3Ti$, which is an ordered face-centered cubic structure, has a high degree of coherence with the matrix, and could improve the strength of materials without affecting the plasticity. Further, Ti is quite different from the matrix elements in an atomic radius, resulting in lattice distortion to improve the yield strength and the tensile strength of the alloy. Moreover, a desirable coherent interaction between dual phases of the alloy further ensures excellent plasticity of the alloy.

The present disclosure further provides a method for preparing the high-plasticity dual-phase HEA as described in the above solutions, including:

(1) subjecting a raw material to pretreatment to obtain a high-purity raw material; and (2) melting the high-purity raw material obtained in step (1) to obtain the high-plasticity dual-phase HEA.

In the present disclosure, a raw material is subjected to pretreatment to obtain a high-purity raw material.

In some embodiments, the raw material includes Ni, Cr, Ti, Fe, and Co. Errors in alloy composition may be reduced by limiting components in the raw material to the above-mentioned types.

In some embodiments, the Ni, Cr, Ti, Fe, and Co each have a purity of not less than 99.9%; and the Ni, Cr. Ti, Fe, and Co each are in the form of particles. Impurities in the alloy may be reduced by limiting the purity of Ni, Cr, Ti, Fe, and Co to the above-mentioned ranges, thereby improving the strength and plasticity of the alloy.

In some embodiments, the pretreatment includes subjecting the Ni and the Cr to pickling and ultrasonic cleaning, and subjecting the Fe, the Ti, and the Co to ultrasonic cleaning. The impurities in the raw material may be further removed by the pretreatment of the raw material to improve the properties of the alloy.

In some embodiments, a pickling solution for the pickling is a hydrochloric acid solution or a mixed aqueous solution of nitric acid and hydrofluoric acid: in some embodiments, the pickling solution is the mixed aqueous solution of the nitric acid and the hydrofluoric acid. In some embodiments, the pickling is conducted for 50 s to 70 s. There is no special limitation on a specific operation of the pickling, and operations well-known to those skilled in the art may be used. The oxide layer on the surface of Ni and Cr may be fully removed by limiting a type of the pickling solution and the pickling time in the pickling to the above ranges.

In some embodiments, in the mixed aqueous solution of the nitric acid and the hydrofluoric acid, a mass percentage of nitric acid is in a range of 10% to 30%, preferably 15% to 20%, and a mass percentage of hydrofluoric acid is in a range of 5% to 8%, preferably 5% to 6%. The removal effect of the oxide layer on the surface of Ni and Cr may be improved by limiting a composition of the mixed aqueous solution of the nitric acid and the hydrofluoric acid to the above ranges.

In the present disclosure, there is no special limitation on a concentration of the hydrochloric acid solution, and it may be selected by those skilled in the art according to needs.

In some embodiments, a solvent for the ultrasonic cleaning of Ni and Cr is absolute ethanol. There is no special limitation on operations and a cleaning time of the ultrasonic cleaning, as long as the pickling solution on the surface of Ni and Cr could be cleaned by conventional operations.

In some embodiments, a solvent for the ultrasonic cleaning of Fe, Ti, and Co is absolute ethanol. There is no special limitation on operations and the cleaning time of the ultrasonic cleaning, as long as fouling on the surface of Fe, Ti, and Co could be cleaned by conventional operations.

In some embodiments, after the pretreatment is completed, a pretreated raw material is subjected to drying to obtain the high-purity raw material.

In some embodiments, the drying is conducted by blowing with an air blower. There is no special limitation on a drying time, as long as the raw material could be blown until it is completely dried.

In the present disclosure, after the high-purity raw material is obtained, it is subjected to melting to obtain the high-plasticity dual-phase HEA.

In some embodiments, the melting is conducted in a protective atmosphere; and the protective atmosphere is provided by argon. The melting may be conducted in the protective atmosphere, so as to avoid an oxidation of the alloy and thereby prevent the reduction of the plasticity of the alloy.

In some embodiments, the melting is conducted in a melting chamber. In some embodiments, before the melting is conducted, the method as described in the above solutions further includes subjecting the melting chamber to primary vacuumizing, and introducing a protective atmosphere until a pointer of a gas valve points to 0 MPa, and then subjecting the melting chamber to secondary vacuumizing, and introducing the protective atmosphere until the pointer of the gas valve points to −0.05 MPa.

In some embodiments, the primary vacuumizing is conducted to a vacuum degree of not less than $8.4\times10^{-4}$ MPa. Oxidation of the alloy during the melting may be avoided by limiting the vacuum degree to the above range.

In some embodiments, the secondary vacuumizing is conducted to a vacuum degree of not less than $3.0\times10^{-3}$ MPa. The oxidation of the alloy during the melting may be further avoided by limiting the vacuum degree of the secondary vacuumizing to the above range.

In some embodiments, a crucible used in the melting is a water-cooled copper crucible. The alloy may be cooled at a relatively high cooling rate by limiting a type of the crucible to be within the above range.

In some embodiments, the melting is conducted 3 to 5 times; and the melting is conducted at a temperature of 1,950 °C to 2,050 °C, preferably 2,000 °C. In some embodiments, the melting is conducted for 55 s to 65 s, preferably 60 s each time. The strength and plasticity of the alloy may be improved by setting various parameters of the melting within the above ranges.

In some embodiments, the melting is conducted at a current of 190 A to 240 A, preferably 200 A to 230 A. All of the elements in the alloy may be fully melted by setting the current for melting within the above range.

In some embodiments, a stirring current is turned on during the melting. There is no special limitation on a magnitude of the stirring current, as long as a molten alloy could be rotated uniformly. The composition uniformity of a resulting ingot is ensured by turning on the stirring current.

In some embodiments, after the melting is completed, an alloy obtained after the melting is cooled to room temperature and then wiped to obtain the high-plasticity dual-phase HEA.

In some embodiments, the cooling is conducted by furnace cooling.

In some embodiments, a solvent used for wiping is absolute ethanol. There is no special limitation on wiping operations, as long as dirt on a surface of the alloy could be wiped off.

The technical solutions of the present disclosure will be clearly and completely described below with reference to the examples of the present disclosure. Apparently, the described examples are merely a part rather than all of embodiments of the present disclosure. All other embodiments obtained by those skilled in the art based on the examples of the present disclosure without creative efforts shall fall within the scope of the present disclosure.

Example 1

This example provided a high-plasticity dual-phase HEA, where the high-plasticity dual-phase HEA has a chemical formula of $Fe_{24.4}Co_{24.4}Ni_{24.4}Cr_{24.4}Ti_{2.4}$.

A method for preparing the high-plasticity dual-phase HEA was performed as follows:

(1) Ni and Cr particles were subjected to pickling for 1 min to remove an oxide layer on the surface. After the pickling was completed, a resulting material was put into absolute ethanol and then subjected to ultrasonic cleaning. Fe, Ti, and Co particles were put into absolute ethanol and then subjected to ultrasonic cleaning. A resulting raw material obtained after ultrasonic cleaning was then completely dried by blowing with an air blower to obtain a high-purity raw material. The pickling was conducted by using a mixed aqueous solution of nitric acid and hydrofluoric acid, and in the mixed aqueous solution of nitric acid and hydrofluoric acid, a mass percentage of nitric acid is 15%, and a mass percentage of hydrofluoric acid is 5%.

(2) The high-purity raw material obtained in step (1) was weighed according to a composition ratio, and a total weight of the raw material was 50 g. The weighed high-purity raw material was put into a water-cooled copper crucible, and a melting chamber was sealed and then subjected to primary vacuumizing until the melting chamber had a vacuum degree of $8.4\times10^{-4}$ MPa. After reaching the above vacuum degree, argon was introduced until a pointer of a gas valve pointed to 0 MPa. After that, secondary vacuumizing was conducted to a vacuum degree of $3.0\times10^{-3}$ MPa. and then argon was introduced again until the pointer of the gas valve pointed to −0.05 MPa. Melting was then conducted at a current of 210 A by flipping 3 to 5 times, where a stirring current was turned on during the melting to ensure the uniformity of the composition of an ingot. After the melting was completed, the melting chamber was cooled to room temperature, a resulting sample was removed from the melting chamber, and dirt on the surface of the resulting sample was wiped off with absolute ethanol to obtain the high-plasticity dual-phase HEA: where the melting was conducted at 2.000 °C for 60 s each time.

The phase analysis of the high-plasticity dual-phase HEA prepared in Example 1 was conducted with a Japanese Rigaku D/max-2500 X-ray diffractometer (XRD), and a resulting XRD pattern is shown in FIG. 1. The working parameters for this test process was as follows: Cu target Kα radiation, a working voltage of 40 kV, a scanning speed of 1°/min. a scanning range of 20° to 100°, and an alloy sample size of 10 mm×10 mm×2 mm. Before the test, the sample was polished to 1500 #with sandpaper, and a sample obtained after polishing was subjected to ultrasonic cleaning in alcohol for 2 min to 3 min. and then dried with cold air for later use.

The high-plasticity dual-phase HEA prepared in Example 1 was tested for its tensile properties, and a specific testing method was as follows.

A room-temperature tensile test of the alloy was conducted with a CMT5150 electronic universal testing machine, where a tensile sample had a gauge length of 6 mm and a tensile rate of 0.18 mm/min.

TABLE 1

Properties of the high-plasticity dual-phase HEA prepared in Example 1

| Example | Properties | | |
|---|---|---|---|
| | Maximum tensile strength (MPa) | Yield strength (MPa) | Elongation (%) |
| Example 1 | 710 | 400 | 62 |

As shown in the XRD pattern of FIG. 1, the phases of the high-plasticity dual-phase HEA prepared in Example 1 consist of a face-centered cubic phase and a small amount of hexagonal close-packed phase.

As can be seen clearly from the properties of the high-plasticity dual-phase HEA prepared in Example 1 recorded in Table 1, the high-plasticity dual-phase HEA has a maximum tensile strength of 710 MPa, a yield strength of 400 MPa, and an elongation of 62%, thereby ensuring excellent plasticity and a high strength.

In the present disclosure, combined with the traditional alloy design method, a dual-phase HEA with high plasticity is prepared by taking FeCoNiCr HEA as a matrix, adjusting the components in a small amount, adding a small amount of Ti which differs greatly from the matrix elements in atomic radius, and further controlling the vacuum degree, protective atmosphere, and melting current during the melting. This provides a technical route to improve the composition design and preparation of the high-plasticity dual-phase HEA.

The above descriptions are merely preferred embodiments of the present disclosure. It should be noted that for a person of ordinary skill in the art, several improvements and modifications may be made without departing from the principle of the present disclosure, and such improvements and modifications should be deemed as falling within the scope of the present disclosure.

What is claimed is:

1. A method for preparing a dual-phase alloy, the dual-phase alloy having a chemical formula as shown in Formula I: $(FeCoNiCr)_{100-x}Ti_x$ Formula I, wherein x is in a range of 2.0 to 2.8; and the method comprising:

(1) subjecting a raw material to pretreatment to obtain a pretreated raw material; and (2) melting the pretreated raw material obtained in step (1) to obtain the dual-phase alloy; wherein the raw material in step (1) comprises Ni, Cr, Ti, Fe, and Co; and the pretreatment in step (1) comprises:

subjecting the Ni and the Cr to pickling and ultrasonic cleaning, and subjecting the Fe, the Ti, and the Co to ultrasonic cleaning.

2. The method of claim 1, wherein the pickling is conducted for 50 seconds to 70 seconds.

3. The method of claim 1, wherein a pickling solution for the pickling comprises one selected from the group consisting of a hydrochloric acid solution and a mixed aqueous solution of nitric acid and hydrofluoric acid.

4. The method of claim 3, wherein in the mixed aqueous solution of nitric acid and hydrofluoric acid, a mass percentage of nitric acid is in a range of 10% to 30%, and a mass percentage of hydrofluoric acid is in a range of 5% to 8%.

5. The method of claim 1, wherein the melting in step (2) is conducted in a protective atmosphere.

6. The method of claim 5, wherein the protective atmosphere is provided by argon.

7. The method of claim 1, wherein the melting in step (2) is conducted in a melting chamber.

8. The method of claim 1, wherein the melting in step (2) is conducted 3 to 5 times.

9. The method of claim 1, wherein x is 2.4.

10. A method for preparing a dual-phase alloy, the dual-phase alloy having a chemical formula as shown in Formula I: $(FeCoNiCr)_{100-x}Ti_x$ Formula I, wherein x is in a range of 2.0 to 2.8; and the method comprising:

(1) subjecting a raw material to pretreatment to obtain a pretreated raw material; and (2) melting the pretreated raw material obtained in step (1) to obtain the dual-phase alloy;

wherein the melting in step (2) is conducted in a melting chamber; and wherein before the melting is conducted, the method further comprises subjecting the melting chamber to primary vacuumizing, and introducing a protective atmosphere until a pointer of a gas valve points to 0 MPa, and then subjecting the melting chamber to secondary vacuumizing, and introducing the protective atmosphere until the pointer of the gas valve points to −0.05 MPa.

11. The method of claim 10, wherein the primary vacuumizing is conducted to a vacuum degree of not less than $8.4\times10^{-4}$ MPa.

12. The method of claim 10, wherein the secondary vacuumizing is conducted to a vacuum degree of not less than $3.0\times10^{-3}$ MPa.

13. A method for preparing a dual-phase alloy, the dual-phase alloy having a chemical formula as shown in Formula I: $(FeCoNiCr)_{100-x}Ti_x$ Formula I, wherein x is in a range of 2.0 to 2.8; and the method comprising:

(1) subjecting a raw material to pretreatment to obtain a pretreated raw material; and (2) melting the pretreated raw material obtained in step (1) to obtain the dual-phase alloy;

wherein the melting in step (2) is conducted 3 to 5 times; and wherein the melting in step (2) is conducted at a temperature of 1,950 °C to 2,050 °C for 55 seconds to 65 seconds each time.

* * * * *